US005664705A

United States Patent [19]

Stolper

[11] Patent Number: 5,664,705

[45] Date of Patent: Sep. 9, 1997

[54] SEALED CONTAINER FOR LIQUIDS PARTICULARLY BEVERAGES

[76] Inventor: Daniel Stolper, 36 Ben Maimon, Jerusalem, Israel, 92261

[21] Appl. No.: 304,640

[22] Filed: Sep. 12, 1994

Related U.S. Application Data

[63] Continuation of Ser. No. 844,117, Mar. 2, 1992, abandoned, which is a continuation-in-part of Ser. No. 758,279, Aug. 27, 1991, abandoned, which is a continuation of Ser. No. 560,546, Jul. 30, 1990, abandoned.

[51] Int. Cl.[6] ..... B65D 37/00

[52] U.S. Cl. ..... 222/212; 222/541.4; 215/11.4

[58] Field of Search ..... 222/207, 212, 222/213, 491, 494, 541, 541.4; 215/11.1–11.6; 426/117, 122

[56] References Cited

U.S. PATENT DOCUMENTS

| | | | |
|---|---|---|---|
| 1,360,893 | 11/1920 | Cowie | 215/11.4 |
| 1,977,227 | 10/1934 | Berendt | 222/494 |
| 3,081,006 | 3/1963 | Land | 222/491 |
| 3,833,154 | 9/1974 | Markowitz | 222/212 |
| 4,378,069 | 3/1983 | Franco | 222/541 |
| 4,515,267 | 5/1985 | Welsh | 222/386 |
| 4,646,945 | 3/1987 | Steiner et al. | 222/213 |
| 4,685,577 | 8/1987 | Chen | 215/11.4 |
| 4,796,758 | 1/1989 | Hauk | 215/11.6 |
| 4,949,857 | 8/1990 | Russell | 215/253 |
| 4,993,568 | 2/1991 | Morifuji et al. | 215/11.4 |
| 5,072,842 | 12/1991 | White | 215/11.4 |
| 5,101,991 | 4/1992 | Morifuji et al. | 215/11.4 |
| 5,105,985 | 4/1992 | Kroeber | 222/212 |

FOREIGN PATENT DOCUMENTS

| | | | |
|---|---|---|---|
| 669174 | 6/1934 | Germany | 222/494 |
| 2164860 | 4/1986 | United Kingdom | 215/11.1 |

*Primary Examiner*—Andres Kashnikow
*Assistant Examiner*—Philippe Derakshani
*Attorney, Agent, or Firm*—Morgan & Finnegan, L.L.P.

[57] ABSTRACT

A self-supporting, flexible walled container is provided which is closed at the bottom and has a nipple a dispensing portion thereof for providing access to a storage portion of the container. A seal is provided in an interior portion of the container for sealing a quantity of liquid in the storage portion and controlling access to the stored liquid.

23 Claims, 6 Drawing Sheets

SEALED CONTAINER FOR LIQUIDS PARTICULARLY BEVERAGES

This is a continuation of application Ser. No. 07/844,117 filed Mar. 2, 1992 now abandoned, which is a continuation in part of 07/758,279 filed Aug. 27, 1991, now abandoned, which is a continuation of abandoned application Ser. No. 07/560,546 filed Jul. 30, 1990.

BACKGROUND AND OBJECTS OF THE INVENTION

The present invention relates generally to an improved container for dispensing liquids, and more particularly, to an easy to use, inexpensive, safe, sterile, disposable, ready-to-use container for dispensing beverages, liquid formula, and the like.

There are currently numerous types of beverage containers in use today. Many of these devices combine several different components made of different materials. Unfortunately, the individual components are often not only cumbersome and awkward to manipulate, but also contribute significantly to the cost of the final packaged product.

There also exist several types of sanitary and disposable nursing dispensers which come pre-packaged with liquid food. These too, however, suffer from many of the defects associated with other beverage containers in general. For example, Horan, U.S. Pat. No. 2,628,911, discloses a liquid infant food dispenser in which a flexible, inner plastic container is filled with a beverage and positioned inside a second container. A push-down type nipple is also included. The final product offers some convenience, but appears to require a rather complex manufacturing procedure which adds significantly to the ultimate cost. Fouser, U.S. Pat. No. 3,747,791, also describes a nursing dispenser with a separately detachable nipple which is then fitted to a bottle and actuated to break a seal for access to the liquid contents therein. These components can be cumbersome to manipulate and expensive to manufacture.

There presently exists a need for a liquid or beverage container or dispenser which can be easily stored and transported, is convenient and simple to use, and is pliable and elastic so as to be manipulated easily by individuals of all ages and dexterities. There also is a need for a beverage dispenser which is less costly to manufacture than many other prior art devices.

It is therefore an object of the present invention to provide a new and improved container suitable for use in storing and dispensing liquids.

It is a further object of the invention to provide a new liquid dispenser which is self-supporting and yet is also highly pliable so it can be held and manipulated by consumers of varying ages and dexterities. It is yet another object of the invention is to provide a new beverage container which is relatively lightweight, sanitary, and ready-to-use.

It is still a further object of the invention to provide a new self-supporting, flexible-walled container which incorporates a seal separating liquid storage from liquid dispensing sections of said container, said seal opening upon application of pressure to said elastic side walls of the container, to allow transfer of liquid from the liquid storage portion to the liquid dispensing portion of the container, and upon release of pressure to reseal the storage portion of the container.

The foregoing specific objects and advantages of the invention are illustrative of those which can be achieved by the present invention and are not intended to be exhaustive or limiting of the possible advantages which can be realized. Thus, these and other objects and advantages of the invention will be apparent from the description herein or can be learned from practicing the invention, both as embodied herein or as modified in view of any variations which may be apparent to those skilled in the art. Accordingly, the present invention resides in the novel parts, constructions, arrangements, combinations and improvements herein shown and described.

SUMMARY OF THE INVENTION

Briefly described, the present invention comprises a container having elastic walls for storing liquids such as beverages or liquid formula, which are stored within a storage portion, and dispensing such liquids by application of pressure to the elastic walls around the storage portion, which causes the stored liquid to flow from the storage portion to a dispensing portion, for example a nipple, through a seal, which separates the two portions and also maintains a sterile environment within the storage portion. The dispensing portion is enclosed and preferably tapers to form a nipple, through which an infant, toddler, or other may access the stored fluids.

According to one specific aspect of the invention, the seal comprises a support member having an overlapping sealing end, and a plurality of valve members mounted on the support member, where each valve member slightly overlaps an adjacent valve member, where the valve members are arranged along the circumference of the support member, and form a pyramid or cone-shaped structure atop the support member.

As preferably embodied, the overlapping valve members are formed physically attached to one another in the cone configuration, but are separable by breaking score lines cut between each valve member. Application of pressure to the storage portion, compresses both the storage portion and a fluid stored within the storage portion, which puts pressure upon the seal causing the valve members to separate, thereby opening the seal and allowing the fluid stored within the storage portion to flow into the dispensing portion through the now opened seal. When the pressure is no longer applied, the seal reverts back to a closed position, and the fluid flow ceases. The amount of fluid desired is thus regulated by the user, and the amount of fluid subject to spillage reduced.

In an alternative embodiment of the invention, the dispensing portion is open to the air and the container is in the form of a drinking glass. As with the first embodiment, a user may squeeze the storage portion of said container, whereby fluid flows through the opened seal to the dispensing portion, which now contains the desired amount of fluid.

In another embodiment of the invention, the seal has a cover which is rupturable. Upon application of pressure to the storage portion, the seal cover ruptures and partially detaches from the seal structure. The fluid stored within the storage portion may then freely flow into the dispensing portion. When the pressure is removed, however, the seal will not necessarily revert back to a closed position.

It will be appreciated by those skilled in the art that the foregoing brief description and the following detailed description are exemplary and explanatory of the present invention, but are not intended to be restrictive thereof or limiting of the advantages which can be achieved by the invention. Thus, the accompanying drawings, referred to herein and constituting a part hereof, illustrate preferred embodiments of the invention and, together with the detailed description, serve to explain the principles of the invention.

DETAILED DESCRIPTION OF THE PREFERRED EMBODIMENTS

Figure 1:
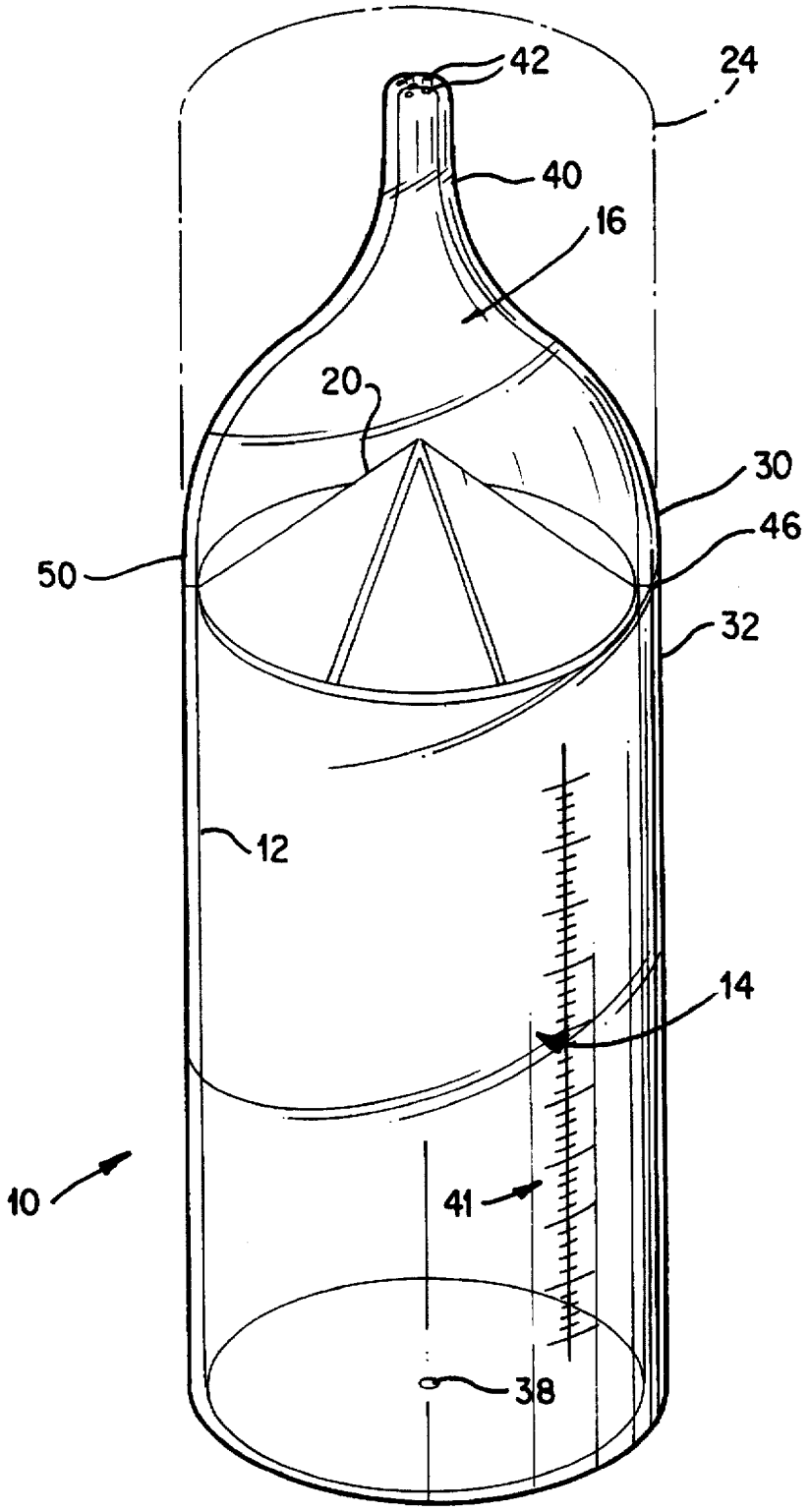
FIG. 1 is a side view of one embodiment of a container and seal according to the present invention.

Referring now to the accompanying drawings, wherein like reference characters refer to like parts throughout the various views, there are shown in FIGS. 1–5 the preferred embodiments of the container according to the present invention.

FIG. 1 shows that the container of the present invention (indicated generally by reference numeral 10) comprises an upper section 30, a lower section 32, and a seal 20, all integrated into a unitary assembly as more fully described below. The upper section 30 and lower section 32 of container 10 are preferably manufactured from one of the numerous plastic materials well-known to those skilled in the art, for example, polypropylene, polyethylene, or any other synthetic material capable of withstanding the heat of sterilization procedures. The upper 30 and lower section 32 are preferably manufactured separately by injection molding or "blow-molding," and then joined together, for example by ultrasound welding, at a juncture 46. The seal 20 is placed within the interior portion of the container 10 prior to joining the upper and lower sections. The seal 20 separates the interior portion into two compartments: a dispensing portion 16 above the seal 20, which is accessible from the exterior, for example by a nipple 40, and a storage portion 14 below the seal.

As here embodied, container 10 is self-supporting, has flexible sidewalls 12 and is formed with a dispensing portion 16 and a storage portion 14. Preferably, the flexibility of the sidewalls 12 of container 10 varies from the dispensing portion 16 to the storage portion 14, such that dispensing portion 16, from which one may access the stored fluids, is more pliable and flexible than is the storage portion 14. Although less supple and pliable than the dispensing portion 16, storage portion 14 is elastic enough to resume its shape after deformation, and is also firm enough so that it may be gripped and also provide the base for the self-supporting container. The variation in pliability may be achieved by varying either the types of materials comprising the dispensing and storage portions of container 10, or, if these portions are made from the same material, varying the thickness of the material used, methods well-known to those skilled in the art.

According to the invention, the dispensing portion 16 is sufficiently pliable and supple so that it can be manipulated easily without causing creases, cracks, or breaks to the material from which the container 10 is manufactured. The dispensing portion is also sufficiently elastic so that it substantially resumes its original shape upon deformation. As here embodied, the dispensing portion 16 preferably tapers to form a nipple 40 having pre-punctured holes 42 at the tip, which allows access to the dispensing portion 16. For applications of the invention involving use by a baby or a toddler, dispensing portion 16 should be pliable and elastic with sufficient flexibility to allow the baby or toddler to nurse and suckle, yet at the same time be of durable quality in order to resist degradation due to repeated biting and chewing.

As shown in FIG. 1, seal 20 separates the interior portion of the container 10 into a portion for dispensing 16 and a portion for storage 14. The seal should be so positioned that at least about 10% of the volume of said interior is in said storage portion 14, more preferably about 50%, and most preferably about 60–95%. The remaining interior volume is in the dispensing portion 16.

Various liquid or semi-liquid contents capable of flow can be injected directly into the storage portion 14 through a hole 58, preferably at the base of container 10, by means of a syringe or other injection device. The hole 58 may then be heat-sealed after the injection, sealing the contents in the storage portion 14 and keeping the contents sterile. The sterile environment within the storage portion 14 may be further maintained by keeping the liquids stored in the storage portion 14 separated from the dispensing portion 16, which is accessible to a user.

The liquid contents can be consumables, for example, water, fruit juices, ultrahigh temperature (UHT) milk, or carbonated or alcoholic beverages, among others. However, the liquid contents may also be non-consumable liquids, such as medicinals, perfume, glue, alcohol or any of a number of liquids that are susceptible to evaporation.

Also shown in FIG. 1 is a vacuum sealing means 24 which may be detachably affixed over the dispensing portion 16 of the container 10. The vacuum sealing means provides airtight, sanitary protection for the dispensing portion of the container and can be, for example, a removable zip seal 44 (shown in FIG. 5) or a cap 48 (shown in FIG. 1). In the event container 10 is dropped, the vacuum sealing means 24 fitting over the dispensing portion 16 prevents fluids within the dispensing portion 16 from spilling and also prevents this fluids within the storage portion 14 from becoming contaminated. Whereas the vacuum cap 48 preferably fits over only the dispensing portion 16, the zip seal 44 may cover the dispensing portion 16 or enclose the entire container 10. The vacuum seal should be applied onto container 10 immediately after manufacturing in order to maintain initial sterile conditions of the materials. To further maintain a sterile environment within the container 10, the air within the dispensing portion 16 may be evacuated, forming a partial vacuum within the dispensing portion and the vacuum seal placed atop the dispensing portion. Since the dispensing portion 16 may include a nipple 40 having pre-punctured holes 42 to the outside, the dispensing portion cannot alone maintain either a vacuum or sterile conditions within the interior of the dispensing portion unless covered by a vacuum seal or cap, which will maintain a partial vacuum within the dispensing portion 16. The ultimate consumer would gain access to the container by first removing the cap or zip seal, thereby breaking the vacuum.

Also shown in FIG. 1 is an internal seal 20 of container 10, which seals, preferably vacuum seals, the storage portion 14 of the container 10 and any contents therein.

Shown in FIGS. 2A–2D is the preferred embodiment of the seal 20. As shown in FIG. 1, seal 20 is situated inside container 10, preferably near the juncture 46. Seal 20 in its preferred embodiment is a one-way inner valve assembly comprising a support member 39 and triangular-shaped valve members 38. The support member 39 and valve members 38 are preferably manufactured from any number of plastics that are stiff and which may be precision die or laser cut, for example EVA or other plastic materials well-known to those skilled in the art. The seal 20 should be of sufficient durability that its integrity is maintained during shipping and storage.

Figure 2A:
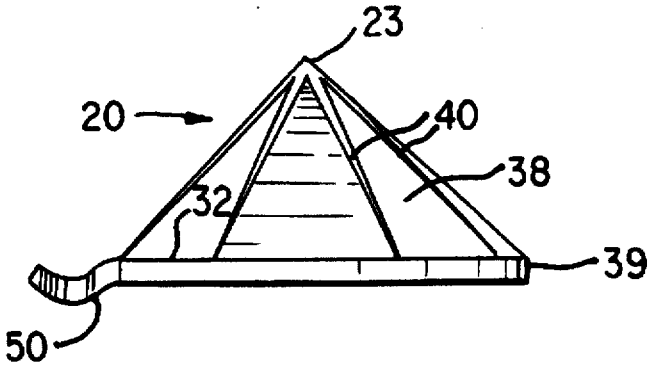
FIGS. 2A and 2B are side and top views of the seal as shown in FIG. 1 in a closed position.
Figure 2B:
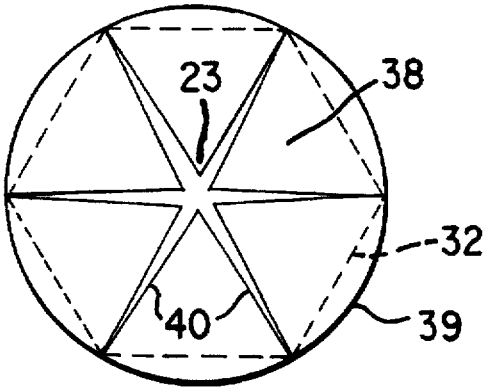
Figure 2C:
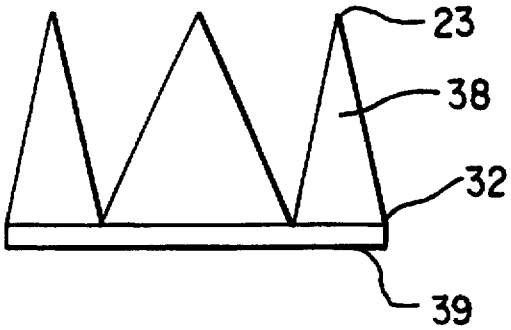
FIGS. 2C and 2D are side and top views of the seal as shown in FIG. 1 in an open position.
Figure 2D:
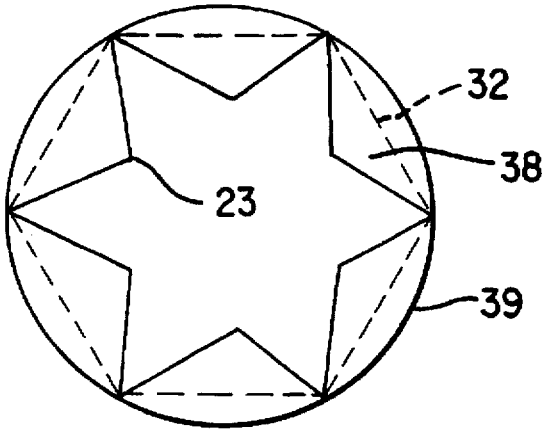

The triangular-shaped valve members 38 have a base 32 and an apex 23. The preferred embodiment shows a combination of six valve members 38 whose bases 32 form an inscribed hexagon within and on top of the circular support member 39, as shown in FIG. 2B. Each triangular-shaped valve member 38 overlaps and supports the next valve member, forming the conical seal structure shown in FIG. 2A. Further, each valve member 38, anchored to support member 39, is able to pivot about the base 32 from a closed seal position, as shown in FIGS. 2A and 2B, to an open seal position, as shown in FIGS. 2C and 2D. Since each valve member 38 overlaps the next, the valve members move in tandem and cannot pivot downward any further than is shown in FIG. 2A since each valve member blocks the others.

The individual valve members 38 of seal 20 are preferably affixed to each other and the support member 39 during the manufacture of the seal structure, forming a sterile seal, which also prevents all movement of the valve members that could compromise the initial sterile environment. However, in using the container the seal must eventually be broken. Thus, between each valve member 38 is a score line 40 from the apex 23 to near the support member 39. Each score line 40 is formed either in the molding process of manufacture as above, or cut by laser or die. Preferably, as the score 40 descends downwards from apex 23 it gradually becomes less deep, i.e. the scoring is greatest at the apex area. The gradual scoring allows for easier opening of the seal (by liquid pressure) and an efficient, snap-back resealing.

Base 39 is preferably ring-shaped and has an overlapping end 50 extending all around the base. The overlapping end 50 is used in securing the seal 20 to the side walls 12 of the container 10. FIG. 2A only shows a portion of overlapping end 50 which extends around the circumference of the support member 39. Overlapping end 50 is preferably manufactured from any of the plastics composing the container, for example polypropylene, polyethylene or any other synthetic material capable of withstanding the heat of sterilization procedures.

The seal 20 is preferably affixed to a straightedge portion of the sidewalls 12 of container 10, i.e. the seal should be positioned below a portion of the container indicated at 50, which marks the end of the vertical straight-edged sidewall 12 and the beginning of a curved portion, such as where the dispensing portion 16 tapers towards a nipple 40, as shown in FIG. 1. Although the seal 20 need not be affixed to a vertical sidewall 12 of container 10 near the juncture 46 of the upper section 30 and lower section 32, the preferred placement of seal 20 is at the juncture 46, which would allow all three pieces, the upper section 30, the lower section 32 and seal 20, to be affixed at the same time. Although the position of the seal 20 within container 10 should be as high as possible to obtain greater storage contents, the seal should not be so high as to interfere with the use of a nipple 40. Further, affixing the seal onto the curved sidewalls 12 of the top section 30 above point 50 is more complicated and expensive to manufacture than the simpler affixation along a straightedge, and is thus not preferred.

Figure 3A:
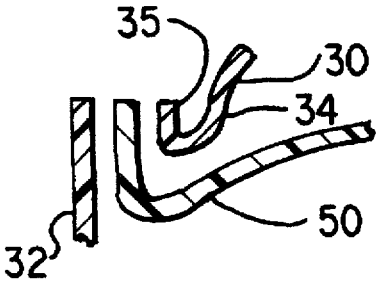
FIG. 3A is a side cross-sectional view of one way of aligning the surfaces of the container and seal.

FIG. 3A shows one manner of connecting the two sections of container 10 and the seal 20 to form a device according to the present invention. As shown in FIG. 3A, three parallel surfaces are aligned: the uppermost part of the lower section 32, the tip of the overlapping part 50 of the seal 20, and the straight section 35 of a curved bottom portion 34 of upper section 30. The aligned surfaces are then affixed together by glue, heat welding or preferably ultrasound welding. Ultrasound welding is the most reliable and cleanest method in forming a seal with the above three surfaces.

Figure 3B:
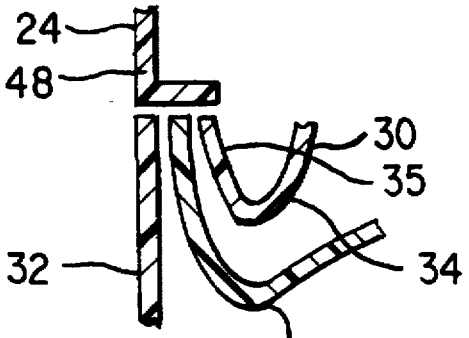
FIG. 3B is a view as shown in FIG. 4A which includes a vacuum sealing cap surface.

FIG. 3B shows the three parallel surfaces as shown in FIG. 3A and a vacuum sealing cap 48 which provides an additional surface which may also be affixed to the three surfaces shown in FIG. 3A. Note that the addition of this cap surface increases the total amount of surface area available for welding, thereby increasing the strength of the weld.

Figure 3C:
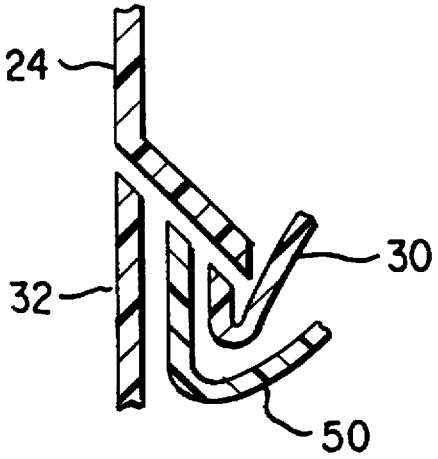
FIGS. 3C–3E are side cross-sectional views of alternate ways to align the surfaces of the container sections, seal, and vacuum cap.
Figure 3D:
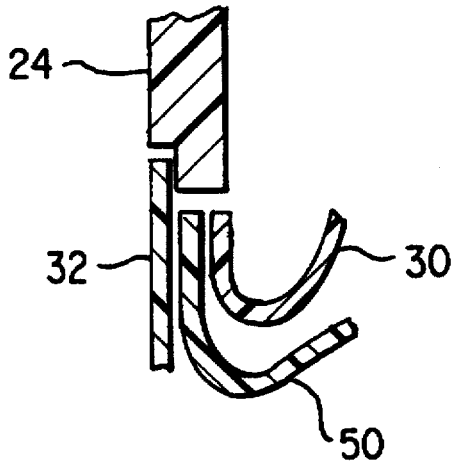
Figure 3E:
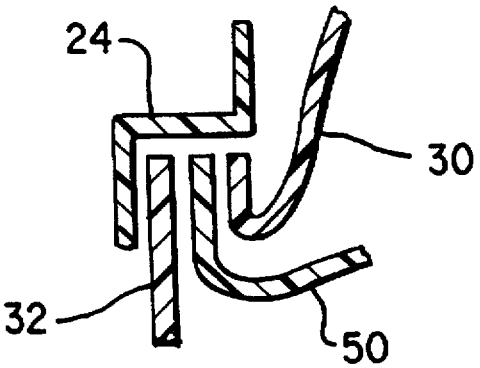

FIGS. 3C–3E show alternative alignments of the above surfaces. The affixation, such as by ultrasound welding, of the surfaces shown in FIGS. 3A–3E is done all the way around the container so as to surround the container 10 and provide a tight and sterile seal for keeping the enclosed liquids.

When external pressure is applied to the container 10 along the side walls of the storage portion 14, valve members 38 pivot open, as shown in FIGS. 2C and 2D, and allow the fluid to flow into the dispensing portion 16. Upon release of the applied pressure, the valve members 38 return to their original position, resealing the seal 20 until further pressure is applied.

As noted, each valve member 38 may be attached to the others during manufacturing in order to maintain a sterile seal on the storage portion 14. Score lines 40 preferably separate the individual valve members. Upon application of pressure to the storage portion 14, the valve members open, separating from each other along the score lines 40. Since the score lines are cut deepest at the apex 23, allowing the valve members to easily separate, the amount of pressure or squeezing required to break apart the individual valve members 38 is reduced. The depth of the scoring should be deep enough to allow valve member separation upon squeezing, but not deep enough that any pressures, for example jostling during transportation, break the score lines, thereby breaking the seal.

A user, for example an infant, of the container shown in FIG. 1 may access and control the flow of the enclosed fluid, for example presterilized formula, to the dispensing portion 16 by applying pressure, such as by squeezing, to the side walls 12 of the storage portion 14. Where the container 10 has not been previously used and the valve members 38 are attached, pressure on the sidewalls 12 of the storage portion 14 will separate the valve members 38 along the score lines 40, allowing the valves to open and the fluid to flow into the dispensing portion 16. An infant or adult may also control the flow of liquid to the dispensing portion 16 by sucking on the nipple 40 with or without any squeezing by the infant or an adult. Suction applied to dispensing portion 16, for example when a baby or toddler sucks on the nipple of a bottle, creates a partial vacuum which breaks the score lines 40 and separates the valve members 38. The vacuum sealing means 24 should of course be removed prior to any squeezing or sucking on container 10.

External pressure along the sidewalls 12 of the container or increased suction applied through the dispensing portion on the seal 20 causes the valve members 38 of the preferred conical seal to open and the liquid stored within the storage portion 14 to flow through the seal 20 into the dispensing portion 16. The fluid flow into the dispensing portion will continue so long as this pressure (squeezing or sucking) is applied. Termination of the pressure causes the valve members 38 of the preferred seal 20 to close, resealing the storage portion 14, and causing the liquid flow into the dispensing portion 16 to stop. Upon release of the pressure to the sidewalls 12 of the storage portion 14, the valve members 38, made of a stiff plastic material, return to the original closed position, resealing the storage portion. The reseal is supported by opposing air and/or fluid pressure pressing on the top of the now closed seal 20 within the dispensing portion 16.

Manual control of the fluid flow in the above manner allows the user to limit the quantity of fluid to any desired amount, available for drinking or other use, thereby preventing spillage or leakage of the remaining fluid, which stays sealed within the storage portion 14. The liquid contents squeezed or sucked into the dispensing portion 16 may then be accessed, e.g., the user, such as an infant, may drink the fluid through the nipple 40. Additional squeezing of the side walls 12 by the user or sucking on the nipple would cause more liquid to reach the dispensing portion, thereby making that fluid accessible also.

One problem in feeding infants is colic, caused by infants swallowing not only the liquid but also the air within a container, for example a feeding bottle. The present invention helps to prevent colic by limiting the amount of air or other gas that may be ingested during a bottle feeding. As noted, squeezing the storage portion 14 of container 10 forces fluid from the storage portion 14 through the seal 20 into the dispensing portion 16. Sucking by an infant on a nipple 40 will also cause the fluid, e.g. formula, to flow into the dispensing portion 16. This fluid displaces the air in the dispensing portion 16 and also creates a partial vacuum in the storage portion 14, which upon release of the external pressure draws in the displaced air into the storage portion. The dispensing portion 16 now containing formula in place of that air prevents the infant from ingesting that air, thereby preventing colic. Since the volume of the sealed dispensing portion 16 is only a fraction of the total interior portion volume of the container, the amount of air available for ingestion by an infant is thereby limited.

Figure 4:
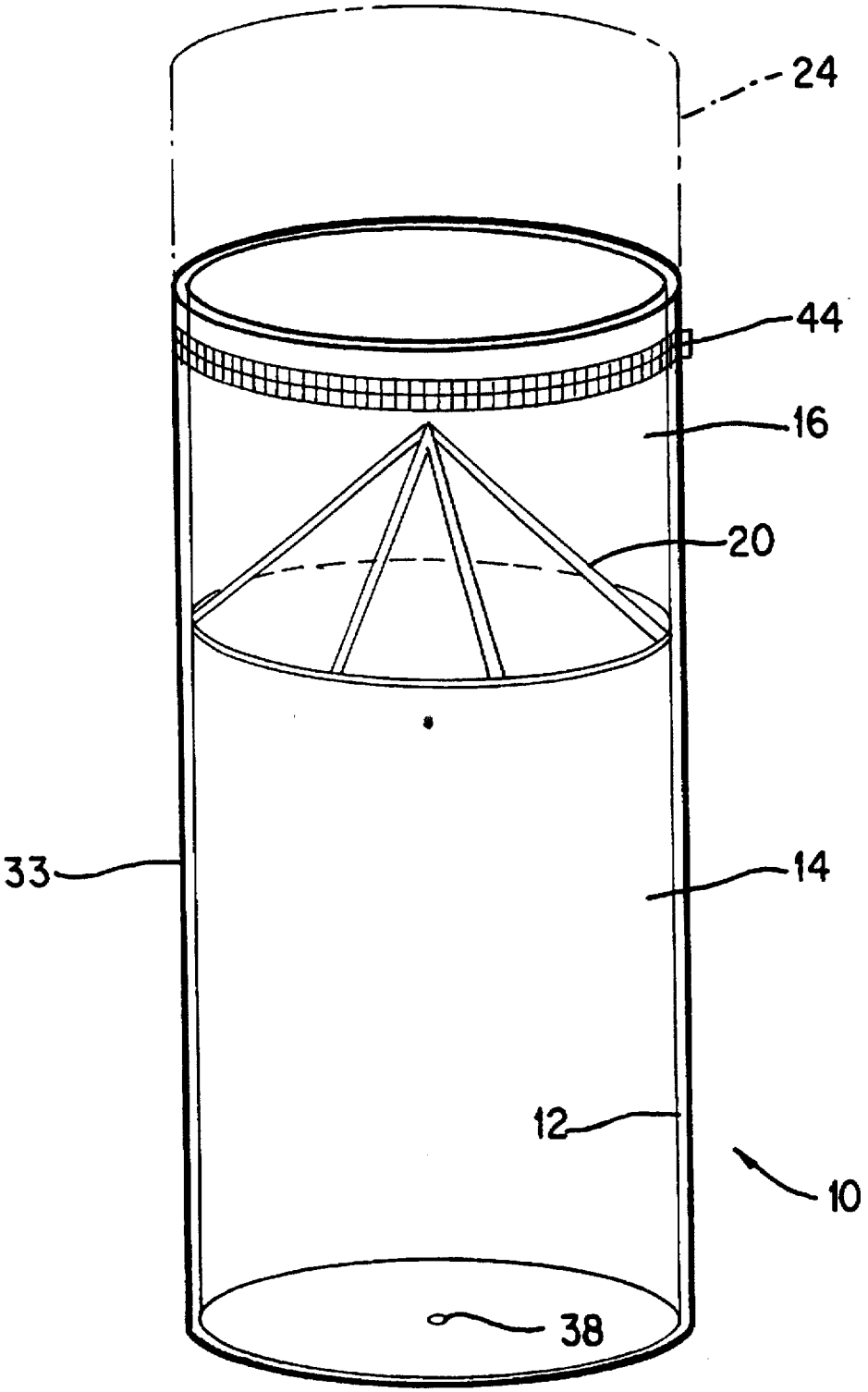
FIG. 4 is a side view of a container according to another embodiment of the present invention.
Figure 5A:
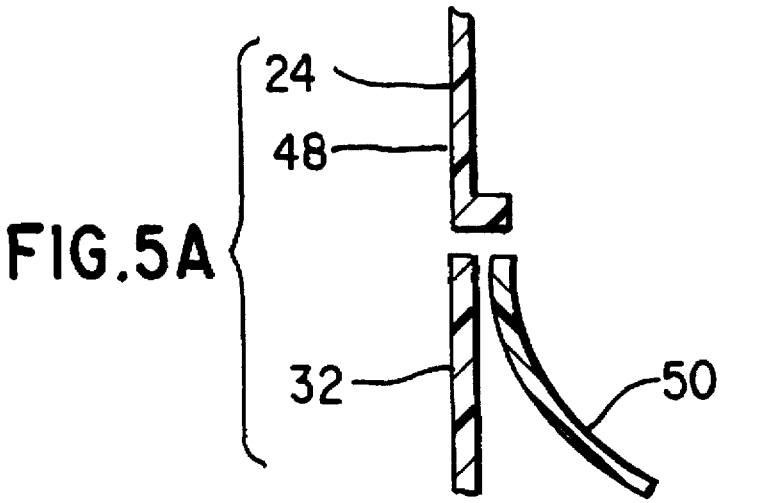
FIGS. 5A–5D are side cross-sectional views of alternate ways to align the surfaces of the container, seal, and vacuum cap for the container shown in FIG. 4.
Figure 5B:
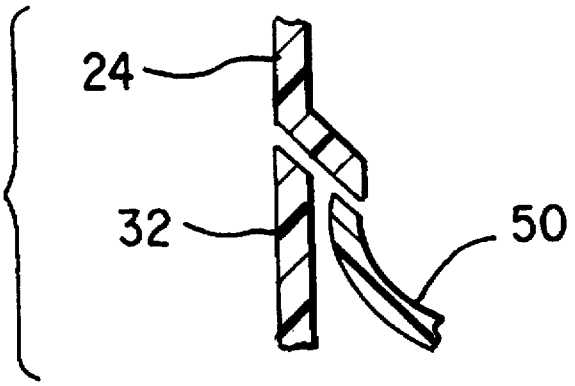
Figure 5C:
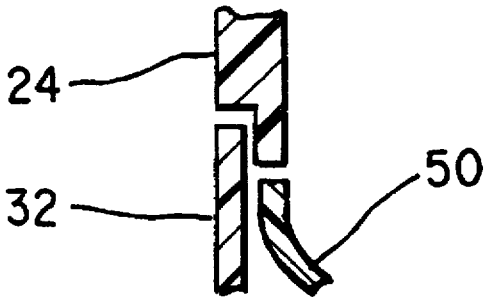
Figure 5D:
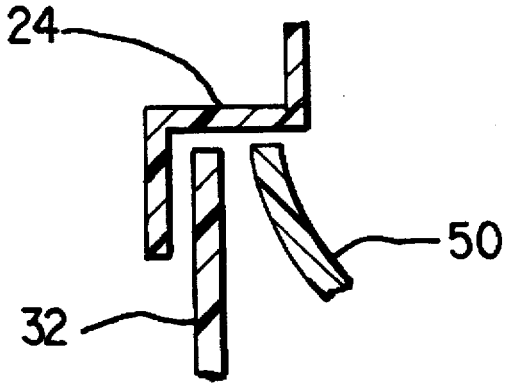

Referring now to FIG. 4, is another embodiment of the present invention, which does not taper to form a nipple as shown in FIG. 1. Instead, the external sides of the dispensing portion 16 are substantially vertical, and the container 10 resembles an ordinary drinking glass. Removal of the vacuum sealing means 24 allows a user to drink from the glass. The dispensing portion 16 in this embodiment is substantially circular and open at the top. This embodiment could be utilized as a drinking container by geriatrics and travelers, among others.

As with the previous sealed containers, the seal 20 allows the user to control the amount of fluid available. External pressure to the side walls 12 of the storage portion 14 allows liquid to flow from the storage portion 14 to the open dispensing portion 16, where it could be consumed or used. Since only small, controlled amounts of fluid are accessible at any one time, only that small amount of fluid may be spilled if the container 10 is tipped or dropped. The remaining fluid in storage portion 14 stays sealed until pressure is again applied to the elastic sides of the container.

The container 10 in FIG. 4 may also be composed of upper 30 and lower 32 sections as in the previous embodiment, but is preferably a one-piece construction, composed of a glass-shaped section 33. Since the dispensing portion 16 of this container 10 is not covered, the seal 20 may be affixed separately after manufacture and may be placed at any position along the inside of the container 10. As with the previous embodiment, the preferred placement of the seal 20 is near the top of dispensing portion 16 of the container 10. The open dispensing portion 16 formed by the placement of the seal 20 preferably holds at least about 5% and most preferably 10–25% of the total container volume.

FIGS. 5A–5D show various ways to align and affix the surfaces of the upper sidewall of the glass-shaped section 33, the tip of the overlapping end 50 of seal 20, and vacuum sealing means 24. As with FIGS. 3A–3E, the above surfaces may be glued, heat welded, or preferably ultrasound welded all around the inside periphery of container 10.

Figure 6A:
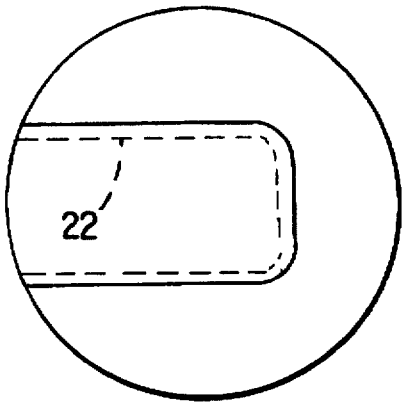
FIGS. 6A–6F are top views of alternative embodiments of the seal.
Figure 6B:
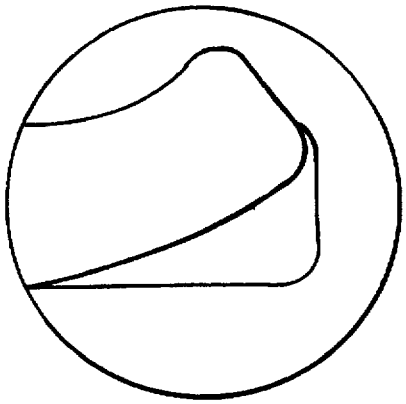
Figure 6C:
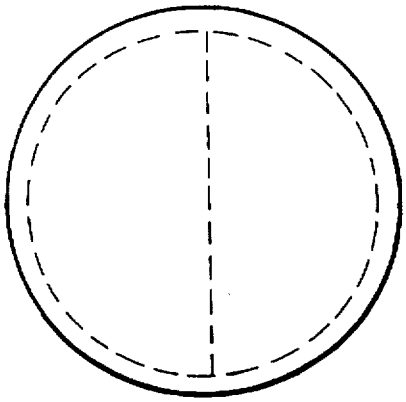
Figure 6D:
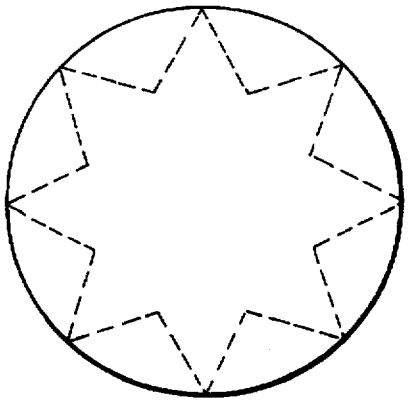
Figure 6E:
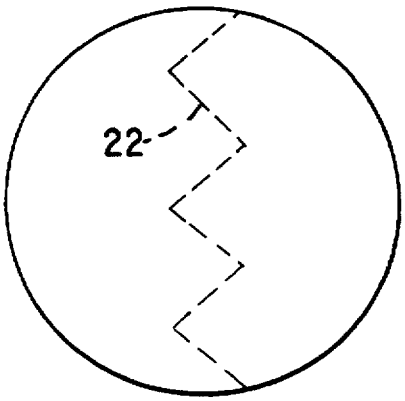
Figure 6F:
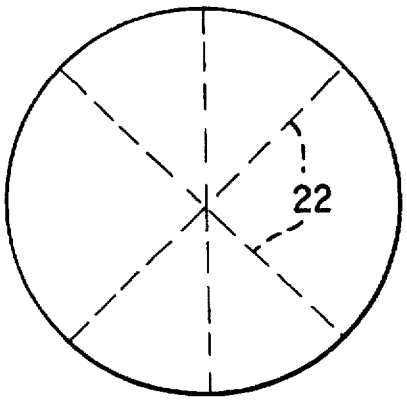

FIGS. 6A–6B show alternative embodiments of the seal 20, which instead of forming a cone structure, employ a rupturable cover 50. However, these alternative seals are substantially flat, and do not have the resealing properties of the preferred embodiment shown in FIG. 2. Upon application of external pressure to a container having rupturable covers, breakaway points 22 rupture, allowing the fluid to flow from the storage portion 14 to the dispensing portion 16. FIGS. 6A and 6B show a seal before and after rupturing. The broken-away piece in FIG. 6B, as with the broken-away pieces in the remaining embodiments, may not reseal the seal 20 when the external pressure is released, and thus cannot maintain sterile conditions within the storage portion 14 as the preferred embodiment can. These alternate embodiments are preferably used for a single application and are disposable, e.g., a single serving of formula which will not be subsequently used. Those skilled in the art may also find that other arrangements of the break-away points will be adaptable for the rupturable seals of the present embodiment.

Also, rupturable seals as described may be used in the preferred conical seal. Instead of score lines, the edges of the triangular-shaped valve members 38 in FIG. 2 may have break points 22 which rupture upon application of pressure.

The present invention should have wide practical utility due at least in part to its overall simplicity. Its design would make it a good choice among manufacturers. Its ease of use would mean that parents could use it for dispensing beverages to young children at home or while traveling. Senior citizens and those with physical and mental handicaps could also make excellent use of the present invention. Further, its ease of use would mean that liquids subject to evaporation can be stored and used as needed without fear of losing the remaining fluid. The container 10 can additionally be fitted with liquid measurement markings 41 during the manufacturing process.

It is also preferable that the container be disposable. Thus the container should be composed of a biodegradable plastic material, such as plastic infused with corn starch, for example. The latter has shown the ability to degrade plastic under the action of light, e.g. the sun. Those skilled in the art may also find that other materials, alone or in combination, could be adapted for use in accordance with the invention, for example metallic foils and paper products.

It will be understood by those skilled in the art that the present invention in its broader aspects is not limited to the particular embodiments herein shown and described. Departures may be made therefrom within the scope of the accompanying claims, without departing from the principles of the invention and without sacrificing its chief advantages.

I claim:

1. A self-supporting container comprising a flexible wall defining an interior chamber that is closed at a bottom end, said bottom end supporting said container in an up-right position, a conical inner seal having at least one frangible score line and a peripheral portion, said conical inner seal being circumferentially sealed to said flexible wall along said peripheral portion within said interior chamber to partition said interior chamber into (1) a sealed storage portion defined by said conical seal, at least a portion of said flexible wall and said bottom end, and (2) a dispensing portion, said at least one frangible score line of said conical inner seal extending from said peripheral portion to at least a center of said inner conical seal whereupon separation of said frangible score line forms valve members that open upon application of pressure to said flexible wall portion of said storage portion to discharge fluids stored in said storage portion to flow through said seal to into said dispensing portion of said container, and (b) means in said dispensing portion of said container, that provides external access to fluid contents within said sealed storage portion.

2. A container as claimed in claim 1, wherein said seal closes and said fluid flow stops upon removing said pressure.

3. A container as claimed in claim 1, wherein said valve members of said conical seal open by application of suction to said dispensing portion of said container.

4. A container as claimed in claim 3, wherein said seal closes and said fluid flow stops upon removing said suction.

5. A container as claimed in claim 1, wherein said dispensing portion tapers to form a nipple.

6. A container according to claim 1, wherein said flexible wall of said storage and dispensing portions are manufactured from plastic.

7. A container as claimed in claim 6, wherein said plastic is molded plastic.

8. A container as claimed in claim 6, wherein said plastic is selected from the group consisting of polyethylenes.

9. A container as claimed in claim 1, wherein said storage portion contains at least about 10% of said interior of said container.

10. A container according to claim 1, wherein said sealed storage portion contains a quantity of consumable liquid.

11. A container according to claim 10, wherein said consumable liquid is at least one selected from the group consisting of water, fruit juice, UHT milk and carbonated beverages.

12. A container according to claim 1, wherein said sealed storage portion contains a quantity of non-consumable liquid.

13. A container as claimed in claim 12, wherein said non-consumable liquid is at least one selected from the group consisting of perfume, chemical solvents, and glue.

14. A container as claimed in claim 1, wherein said seal prevents evaporation of liquids stored in said storage portion.

15. A container as claimed in claim 1, further comprising a vacuum sealing means affixed over said dispensing portion of said container.

16. A container as claimed in claim 1, further comprising a vacuum sealing means affixed over said container.

17. A container as claimed in claim 16, wherein said vacuum sealing means is a removable zip seal.

18. A container according to claim 1, wherein said conical seal is integrally formed with said flexible wall.

19. A container according to claim 1, wherein there are a plurality of frangible score lines each originating at a peripheral portion of said conical seal and terminating at the center of said conical inner seal.

20. A self-supporting container comprising a flexible wall defining an interior chamber that is closed at a bottom end, said bottom end supporting said container in an upright position, (a) a conical inner seal having at least one frangible score line and a peripheral portion and, said conical inner seal being circumferentially sealed to said flexible wall along said peripheral portion within said interior chamber to partition said interior chamber into (1) a sealed storage portion defined by said conical seal, at least a portion of said flexible wall and said bottom end, and (2) a dispensing portion, said at least one frangible score line of said conical inner seal extending from said peripheral portion to at least a center of said inner conical seal, where upon separation of said score line forms valve members that open upon application of a partial vacuum pressure causing fluids stored in said storage portion to flow through said seal into said dispensing portion of said container, and (b) means in said dispensing portion of said container comprising a nipple which is sucked by a user to create said partial vacuum pressure and provides external access to fluid contents within said sealed storage portion.

21. A container according to claim 20, wherein there are a plurality of frangible score lines each originating at a peripheral portion of said conical seal and terminating at the center of said conical inner seal.

22. A container comprising:

(a) a self-supporting, flexible walled container which is closed at the bottom end and contains therein a storage portion and dispensing portion, said bottom end being adapted to support said container in an upright self-supporting position, (b) a rupturable seal for sealing said storage portion of said container from said dispensing portion, wherein said seal ruptures upon application of a partial vacuum pressure to said flexible walls of said storage portion, causing fluids stored in said storage portion to flow through said seal to said dispensing portion of said container, and (c) means in said dispensing portion of said container comprising a nipple which is sucked by a user to create said partial vacuum pressure and provides external access to fluid contents within said sealed storage portion.

23. A container according to claims 22, wherein there are a plurality of frangible score lines each originating at a peripheral portion of said conical seal and terminating at the center of said conical inner seal.

* * * * *